United States Patent [19]

Kittel et al.

[11] Patent Number: 4,627,750

[45] Date of Patent: Dec. 9, 1986

[54] RECEIVING ARRANGEMENT FOR A MULTIPLE TYPE CARRIER FOR AN IMPACT PRINTER

[75] Inventors: Arthur Kittel, Wilhelmshaven; Heiner Gerken, Jever, both of Fed. Rep. of Germany

[73] Assignee: Olympia Werke AG, Wilhelmshaven, Fed. Rep. of Germany

[21] Appl. No.: 246,696

[22] Filed: Mar. 23, 1981

Related U.S. Application Data

[63] Continuation of Ser. No. 40,214, May 18, 1979.

[30] Foreign Application Priority Data

May 22, 1978 [DE] Fed. Rep. of Germany ..... 2822313

[51] Int. Cl.[4] ..... B41J 1/30

[52] U.S. Cl. ..... 400/144.2; 400/175; 400/521; 400/699; 400/709.2

[58] Field of Search ..... 400/144.2, 144.3, 174, 400/175, 521, 535, 536, 699, 709, 709.1, 709.2; 101/93.15–93.17

[56] References Cited

U.S. PATENT DOCUMENTS

| | | | |
|---|---|---|---|
| 1,043,282 | 11/1912 | Yelf | 400/699 X |
| 1,544,064 | 6/1925 | McNeal | 400/699 |
| 3,805,697 | 4/1974 | Mahe | 101/111 |
| 4,026,403 | 5/1977 | Inose et al. | 400/144.2 |
| 4,049,109 | 9/1977 | Plaza et al. | 400/175 X |
| 4,075,945 | 2/1978 | Bienholz | 101/111 |
| 4,124,312 | 11/1978 | Johnson | 400/144.2 |
| 4,127,335 | 11/1978 | Bogert et al. | 400/144.2 |
| 4,178,107 | 12/1979 | Guerrini et al. | 400/144.2 |

FOREIGN PATENT DOCUMENTS

| | | | |
|---|---|---|---|
| 2451254 | 5/1976 | Fed. Rep. of Germany | 400/709 |
| 2639872 | 2/1978 | Fed. Rep. of Germany | 400/144.2 |
| 1465193 | 2/1977 | United Kingdom | 400/172 |

OTHER PUBLICATIONS

*IBM Tech. Disc. Bulletin*, vol. 18, No. 10, Mar. 1976, p. 3356.

*IBM Tech. Disc. Bulletin*, by J. A. Craft, vol. 11, No. 4, Sep. 1968, p. 390.

*Primary Examiner*—Paul T. Sewell

*Attorney, Agent, or Firm*—Spencer & Frank

[57] ABSTRACT

In a system including a cassette containing a print wheel arranged to cooperate with holding devices provided in an impact printer having a rotatable setting shaft to which the print wheel can be releasably fastened for rotation therewith, the cassette is formed to enclose the print wheel on all sides except the region where it is to be acted upon by a printing hammer. The printer can be provided with a detent mechanism cooperating with counterdetent elements in the cassette to hold the cassette in a fully inserted position in the printer. The cassette can additionally be provided with an outwardly curved collecting funnel positioned for catching dirt released in the region where the type faces of the printing wheel strike a printing medium. For use in printers in which the setting shaft is mounted on a pivotal carrier in order to pivot into a position which facilitates mounting of the print wheel, the print wheel can be provided with integral protrusions which constitute holding elements for mounting the print wheel directly in the cassette with only bearing play in the axial and radial directions, and the cassette can be provided with bearing surfaces which cooperate with cup-shaped surfaces provided in the printer to prevent rotation of the cassette relative to the printer when the print wheel is fastened to the setting shaft and the setting shaft carrier has been pivoted to bring that shaft into its printing position.

16 Claims, 13 Drawing Figures

RECEIVING ARRANGEMENT FOR A MULTIPLE TYPE CARRIER FOR AN IMPACT PRINTER

CROSS REFERENCE TO RELATED APPLICATION

This application is a continuation of application Ser. No. 040,214, filed May 18th, 1979.

BACKGROUND OF THE INVENTION

The present invention relates to a receiving arrangement for a multiple type carrier, e.g. a print wheel, for use in impact printers in the form of typewriters or similar office machines.

The present invention is particularly directed to a receiving arrangement which effectively protects such a type carrier against damage mainly in the mounted operating state but also in the unmounted state, i.e. when it is removed from the machine, as is the case already with other forms of type carriers, such as, for example, band-like type carriers which are mounted on guide rollers within a cassette-like structure, carriers of this type being disclosed, for example, in German Offenlegungsschrift [Laid-open Application] No. 2,247,926.

Protective containers have already been provided for axially symmetrical, or circular, multiple type carriers to hold the type carriers in the mounted state at a rotatable setting shaft in such a way that during operation the type carriers are substantially protected against inadvertent manual contact. For example, German Offenlegungsschrift No. 2,010,206 discloses a receptacle within a machine for a disc-shaped type carrier in which the type carrier is additionally protected against soiling that may originate from gear members within the machine. As already mentioned, this receptacle is part of the machine frame which simultaneously includes the bearing means for the rotatable setting shaft of the type carrier. This has the result that an operator cannot easily remove such a type carrier from this receptacle for the purpose of exchanging it.

In the printing mechanism disclosed in German Offenlegungsschrift No. 2,455,831, which includes a disc-shaped type carrier, a protective ring is provided in the machine frame concentric with the rotatable type setting shaft so as to protect the type carrier against contact in radial directions. For the purpose of replacement, the type of carrier in this printing machanism can be removed from the rotatable setting shaft in the axial direction, the protective ring remaining in the machine, however. This has the result that, on the one hand, a type carrier that has been removed from an office machine is unprotected against damage at least until it has been deposited into a storage container and, on the other hand, the carriage may soil the operator'fingers since in its regions carrying the printing type it may be soiled considerably from the inking device of the office machine.

German Auslegeschrift [Published Application] No. 2,415,626, moreover, discloses a printing mechanism having a disc-shaped type carrier which is not brought into operating engagement with the rotatable setting shaft directly, but rather indirectly via a disc-like carrier which serves to receive intermediate pieces associated with the individual printing spokes and also to receive an elastic disc which is likewise provided with spokes, these spokes cooperating, on the one hand, with the intermediate pieces and, on the other hand, being accelerratable in the axial direction of the rotatable setting shaft by a printing hammer mechanism for the indirect actuation of the associated type fingers of the type disc. The outer jacket of the disc-like carrier is provided with a ring which protrudes in the axial direction in such a manner that the type disc is protected against manual access. This disc-like type carrier can be fastened to the rotatable setting shaft by means of a screw element. The result is that this type carrier cannot be easily exchanged by an operator.

U.S. Pat. No. 4,127,335 discloses a receiving arrangement for a multiple type carrier, which arrangement has a structure similar to a receiving cassette. This structure has a frontal wall which acts like a shield and which, in the mounted state, faces the operator, i.e. the type carrier is exposed on the side of the shield facing the printing abutment. The type carrier is held at the shield, which is provided with laterally protruding edges of a depth at least equal to that of the thickness of the type carrier, so that the carrier is centered on the one hand, and, on the other hand, is held by friction against the frontal wall of the cassette when it is in the unmounted state. In the mounted state the type carrier is then lifted slightly away from the frontal wall in order to be able to be driven without friction by the drive shaft. A drawback of this receiving arrangement is that, in the unmounted state of the receiving arrangement, the type carrier is not positively secured against inadvertent rotation. As a result, it is necessary to conduct an extended search run of the drive shaft after each exchange of type carriers in order to provide secure engagement of the rotation following means. Moreover, this receiving arrangement cannot reliably protect the operator's fingers against soiling since the shield is completely open particularly on the side where the print type faces of the type carrier are disposed.

U.S. Pat. No. 4,124,312 also relates to a receiving arrangement for a type disc. This cassette is designed to enclose the type disc on all sides, i.e. even in the immediate printing region, which then of course creates considerable difficulties for the operator with respect to being able to see what has just been printed. The operator must practically look through a window in the cassette which is hardly possible from a normal angle of view.

SUMMARY OF THE INVENTION

It is an object of the present invention to provide a receiving arrangement for such a type carrier which assures that the type carrier is protected against damage in the mounted as well as in the unmounted state and which permits easy exchange of type carriers.

A further object of the invention is to prevent inadvertent rotation of the type carrier in the receiving arrangement when in the unmounted state.

Another object of the invention is to provide a receiving arrangement which can perform functions in addition to that of storing the type carrier.

A still further object of the invention is to facilitate viewing of the printing region while enabling the type carrier to be protected on all sides even when the receiving arrangement is in the unmounted state.

Yet another object of the invention is to provide mechanisms which permit convenient mounting of a receiving arrangement carrying a print wheel in an impact printer, and removal of the receiving arrangement therefrom.

These and other objects are achieved, according to the present invention, by the provision of a receiving arrangement in the form of a cassette containing, or arranged to contain, a print wheel provided with a plurality of elastic spokes carrying print type faces, the cassette and print wheel being arranged to cooperate with holding devices provided in an associated impact printer having a printing hammer mechanism arranged to act on the type faces and a rotatable setting shaft to which the print wheel can be releasably fastened for rotation with the shaft, and in which various ones of these components are constructed to present the following groups of features, which groups can be provided individually or in certain combinations:

- the cassette is formed to enclose the print wheel on all sides except for the immediate region where the hammer mechanism acts on a selected type face, the cassette being open along the top thereof, the cassette and print wheel are provided with elements which cooperate to hold the print wheel, when it is disconnected from the rotatable setting shaft, in a predetermined angular position in the cassette, and the cassette is arranged to be held in position in the printer by holding members thereof when the print wheel is fastened to the setting shaft;
- a removable cover member is provided for covering the open side of the cassette and enclosing the print wheel in the region where the hammer mechanism acts on a selected type face;
- the printer is provided with a detent mechanism for holding the cassette in a fully inserted position in the printer, and with an ejection device for urging the cassette away from its fully inserted position, against the action of the detent mechanism, and the cassette is provided with counterdetent elements disposed to engage the detent mechanism;
- the print wheel is provided with positioning elements and the cassette is provided with arresting elements arranged to normally engage the positioning elements in order to hold the print wheel in a predetermined angular position relative to the cassette when the cassette and print wheel are removed from the printer, the arresting elements being disengageable from the positioning elements when the cassette is mounted in the printer and the print wheel is fastened to the setting shaft;
- the cassette is formed, in the region near its top, which is directly opposite the printer platen when the cassette is inserted in the printer, to define a card holder and/or line adjustor;
- the cassette is provided with a guide member presenting a wedge-shaped recess and disposed in the region where the hammer mechanism acts on a selected type face, for effecting lateral guidance, in the recess, of the spoke carrying the selected type face when the hammer mechanism acts on such type face;
- the cassette is provided, at the side thereof which faces the platen when the cassette is inserted in the printer, with an outwardly curved collecting funnel positioned for catching dirt released in the region where the selected type face is pressed against the platen.

The invention is also applicable to an impact printer whose rotatable setting shaft is mounted on a carrier which can be pivoted to move the setting shaft into a position which facilitates mounting of the print wheel. For use in such a printer, objects of the invention are achieved by providing the print wheel with integral protrusions which constitute holding elements for mounting the print wheel directly in the cassette with bearing play in the axial and radial directions. Additionally, according to the invention, the cassette is preferably provided with bearing surfaces, and the printer is provided with cup-shaped surfaces engageable with the bearing surfaces for preventing rotation of the cassette relative to the printer when the print wheel is fastened to the setting shaft and the carrier for the setting shaft has been pivoted to bring that shaft into its printing position.

DESCRIPTION OF THE PREFERRED EMBODIMENTS

Figure 2:
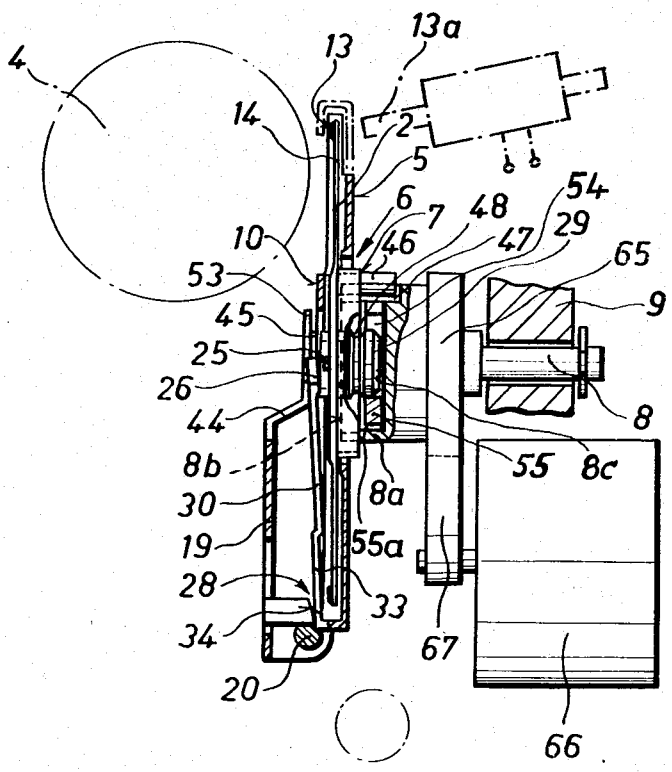
FIG. 2 is a side elevational, cross-sectional view showing the position of the type carrier cassette of FIG. 1 in the mounted state for a printing mechanism in which a rotatable setting shaft is mounted unpivotally in the machine, for example in a type carrier carriage.
Figure 1:
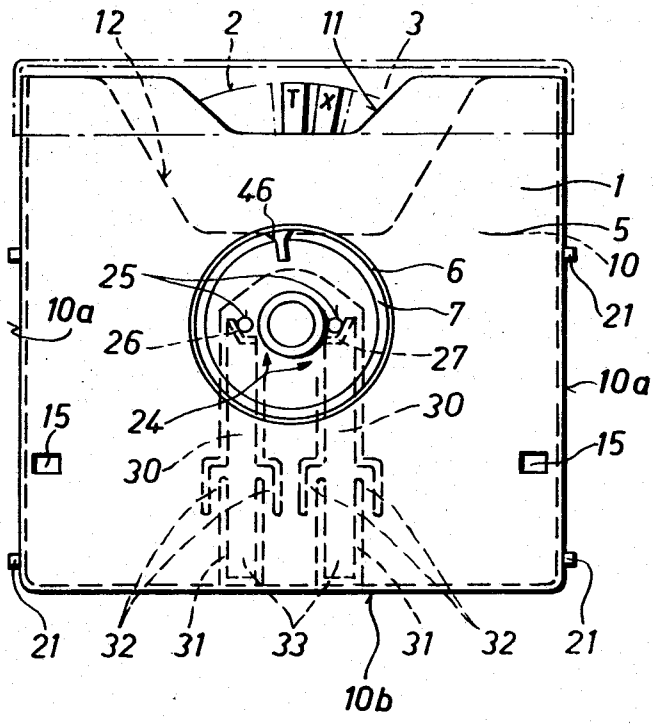
FIG. 1 is a front elevational view of one preferred embodiment of a type carrier receiving arrangement, in the form of a cassette, according to the present invention.

FIGS. 1 and 2 show a receiving cassette 1 for a disc-like multiple type carrier, or print wheel, 2, the cassette being composed of a flat container which in its unmounted state, i.e. when not mounted in an impact printer, or office machine, can be closed by means of a closing cover 3. At its frontal face 5, facing away from a platen 4, the cassette 1 is provided with a bearing opening 6 which serves to receive a protrusion forming a holding means 7 for the print wheel 2. This protrusion on the print wheel 2 is mounted with considerable play in the bearing opening 6 of the cassette 1 so that the cassette can be fastened to a part 9 of the impact printer, part 9 being, for example, a type carrier carriage (not shown in detail), independently of the position of the print wheel 2 which is to be fastened to a rotatable setting shaft 8 and without there existing an effective connection between the cassette and the print wheel.

Cassette 1 is further provided with a rear face 10 parallel to face 5 and directed toward platen 4 when cassette 1 is mounted in the printer, as well as with vertical side faces 10*a* and 10*b* extending over the height of the cassette between faces 5 and 10 and a bottom plate closing the bottom of the cassette and also extending between faces 5 and 10. In the upper region of the cassette 1, faces 5 and 10 are provided with cutouts 11 and 12, respectively, to permit passage of a printing hammer mechanism 13*a*, shown in FIG. 2, cutout 11 being dimensioned so that face 5 provides an abutment for the individual resilient spokes 14 carrying the print faces 13, and cutout 12 being dimensioned to permit the striking movement of same in the direction toward the platen 4.

Figure 7:
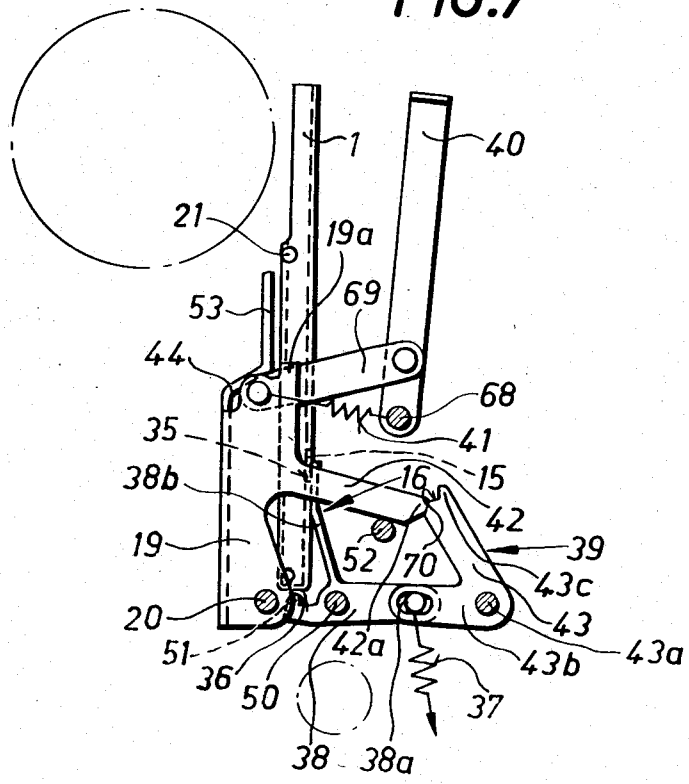
FIG. 7 is a side elevational view of a portion of a cassette retaining mechanism of the embodiment of FIGS. 1–6, in the cassette retaining position and with a cassette inserted.

Furthermore, the frontal face 5 of cassette 1 is provided with passages 15 which serve as counter detent means that can be caused to coact with detent means 16, shown in FIG. 7, disposed in the machine, e.g. in a type carrier carriage. These detent means 16 are disposed in the lower region of an insertion shaft 17, shown in FIGS. 3 and 4, formed by the lateral walls 18 of a portion of the machine, e.g. a carriage, and by a pressure plate 19, shown in FIG. 2, disposed between the two lateral walls 18. Thus, shaft 17 is movable as a unit with the carriage, i.e. only in the direction parallel to the axis of platen 4. The lower end of plate 19 is pivotally mounted on the machine at a shaft 20.

Figure 4:
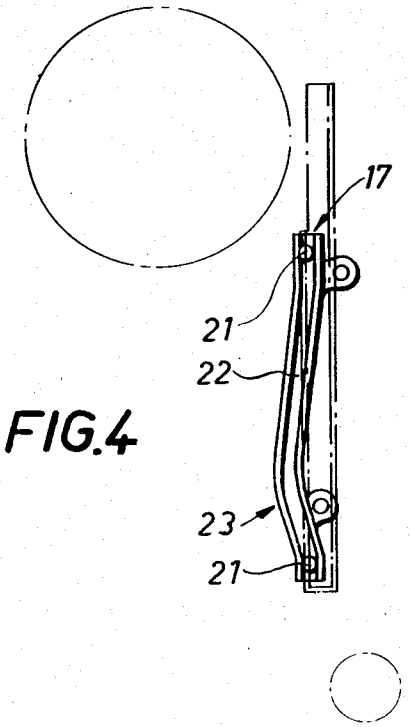
FIGS. 3 and 4 are views similar to those of FIGS. 1 and 2, respectively, of essential parts of an insertion shaft for the type carrier cassette of FIGS. 1 and 2, in the interior of the machine.
Figure 3:
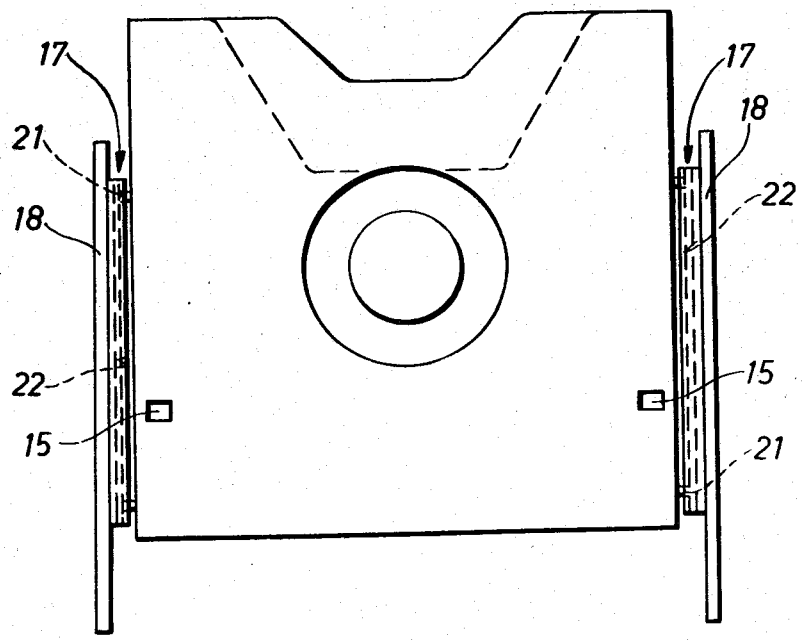

Referring to FIGS. 1, 3 and 4, guide members 21 are formed on the side faces 10*a* of the cassette 1 in the form of pin-like protrusions. They can be inserted from the top into guide grooves 22 provided in the lateral walls 18 of the insertion shaft 17 and extending essentially vertically. Each guide groove 22 is provided with a curved region 23 having such a configuration that the cassette can be adjusted during an inserting movement, which is in the vertical direction and is initially essentially transverse to the axial direction of the rotatable setting shaft 8, so as to provisionally couple the print wheel to the shaft for movement in its axial direction.

Referring to FIGS. 1 and 2, cassette 1 is provided, in its rear face 10, which in the mounted state is oriented toward the platen 4, with two normally inwardly protruding supporting tongues 26 and 27 which act as arresting means 24 for the print wheel 2. These supporting tongues 26 and 27 can be moved out of the effective range of supporting means 25 carried by wheel 2 by means of control members 28 in the interior of the machine. The supporting means 25 are bolt-like protrusions, or pin elements shaped to the hub 29 of the print wheel.

The supporting tongues 26 and 27 are formed at the free ends of leaf springs 30 forming partial regions of the rear face 10 of the cassette 1. For this purpose, recesses 31 are provided in the rear face 10 of the cassette 1 and these recesses are shaped in such a way that two-armed leaf springs 30 are formed which are in pivotally elastic connection with the rear face 10 by means of bars 32 remaining between the above-mentioned partial regions and the remainder of face 10. These bars 32 thus form pivot bearings for the leaf springs 30. As shown in FIG. 1, each leaf spring 30 presents two lever arms one of which carries the supporting tongue 26 or 27, respectively, while the other of which constitutes a control lever arm 33 which, in the mounted state of the cassette, will be brought into effective engagement with one of the control members 28. The control members 28 are each provided with a control slope, or camming surface, 34 and are constituted by protrusions provided at the pressure plate 19.

Figure 8:
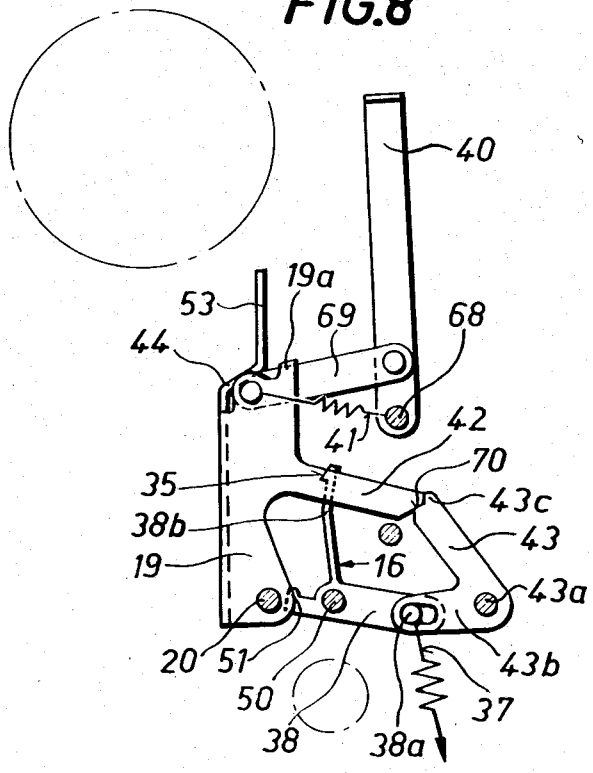
FIG. 8 is a view similar to that of FIG. 7, but with the mechanism in its cassette releasing position and the cassette removed.

Referring to FIGS. 7 and 8, pressure plate 19 is a part of a blocking device 39 and is continuously under the influence of a tension spring 41 which continuously urges it to perform a clockwise pivoting movement. Pressure plate 19 is provided with a first arm 42 with which it can be brought into the range of movement of a blocking lever 43. The blocking lever 43 is pivotally mounted on a shaft 43*a* carried by the machine and is always in operating connection, via a lever arm 43*b*, with a tension spring 37 acting as ejection spring means for exerting a continuous influence in the counterclockwise direction. The first arm 42 of pressure plate 19 and the blocking lever 43 each is provided with a supporting tongue 42*a* or 43*c*, respectively, through which they can take on the detent positions shown in FIGS. 7 and 8 in which they both can take on pivoted positions in either the clockwise direction of FIG. 7 or the counterclockwise direction of FIG. 8.

The blocking lever 43 is in operative connection, via a long pin and hole connection 38*a*, the ejection spring means 37 also engaging this pin, with a control lever 38 which is pivotally mounted to the machine via a bearing 50. This pivot bearing 50 is centered on a common plane with pivot bearings 20 of pressure plate 19 and pivot bearing 43*a* of blocking lever 43, this plane being parallel with the axis of rotatable setting shaft 8. The control lever 38 and the lever arm 43*b* of blocking lever 43, which are connected together via the long pin and hole connection 38*a*, are aligned with respect to one another when in the operating position, shown in FIG. 7, so that the axis of connection 38*a* then also lies on the above-mentioned common plane. Furthermore, a contact tongue 51, when in its effective position, is also disposed on this common plane, the contact tongue 51 being formed on control lever 38.

By means of this contact tongue 51, the control lever 38 can be brought from the position shown in FIG. 8 into the position shown in FIG. 7 upon insertion of cassette 1, when the lower edge of the cassette acts as a control means. In this position, in which the control lever 38 is in a position in which it has been pivoted counterclockwise by manual insertion of the cassette 1 into the insertion shaft 17 during the last portion of the insertion movement against the effect of the ejection spring means 37, the detent means 16 formed of a detent hook 35 formed at the end of a spring arm 38*b* carried by lever 38 moves into the passages 15, shown in FIGS. 1 and 3, which are provided in cassette 1 and act as counter detent means, or detent receivers, so that the cassette is blocked from undergoing an upward return movement. An unlatching movement of control lever 38 under the influence of the ejection spring means 37 is prevented by the supporting tongue 42*a* on pressure plate 19 which has in the meantime been moved in the clockwise direction by the effect of tension spring 41 until reaching an abutment 52 fixed to the machine, and thus blocks the detent lever 43 from making a return movement in the counterclockwise direction.

Figure 5A:
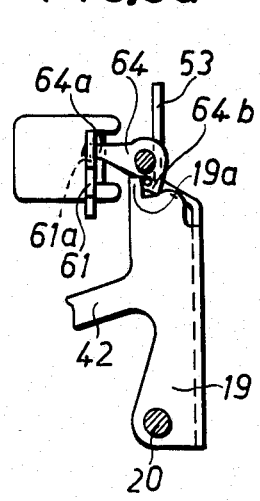
FIG. 5*a* is a side elevational detail view of a portion of the mechanism of FIG. 5 in the wheel holding position.
Figure 5:
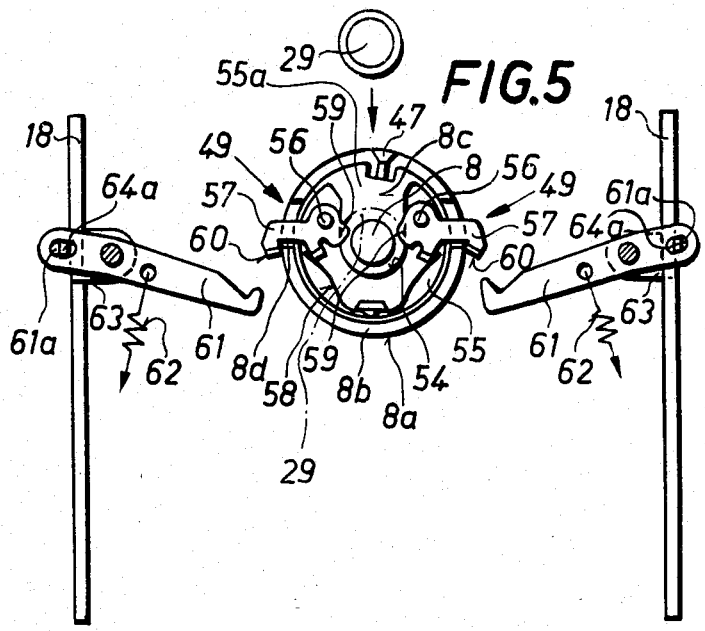
FIG. 5 is a front elevational view of a mechanism forming part of the printer of FIGS. 2–4 for positioning a print wheel relative to a setting shaft, the mechanism being shown in its wheel holding position.
Figure 6:
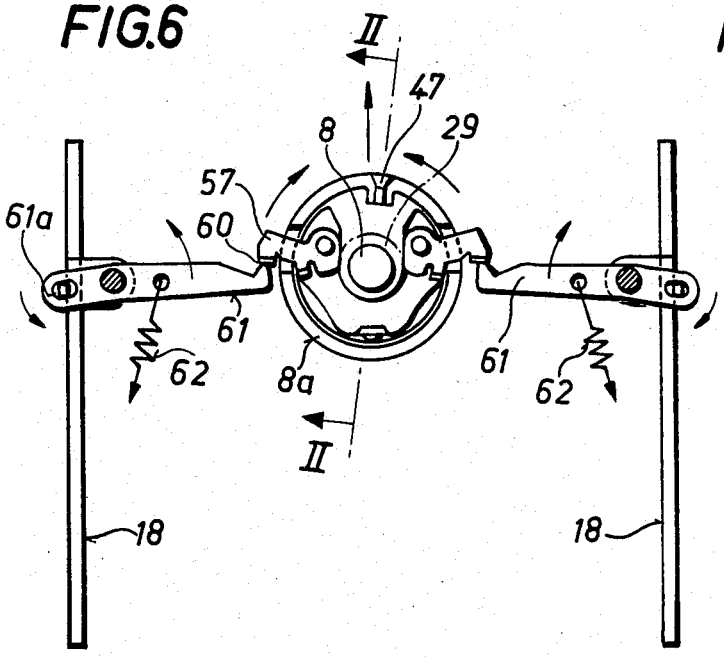
FIG. 6 is a view similar to that of FIG. 5 showing the mechanism in its wheel releasing position.

Referring to FIGS. 2, 5 and 6, pressure plate 19 has a second arm 44 which is provided with a protrusion 53 spaced from, and disposed across the axis of, rotatable setting shaft 8, at the end of shaft 8 directed toward platen 4. This protrusion 53 is provided to press wheel 2 into operative engagement with shaft 8 in that protrusion 53 presses against one frontal face 45 of a hub 29 of print wheel 2 so that wheel 2 is brought into precise contact with the frontal ring 8*b* of a receiving collar 8*a* of the rotatable setting shaft 8 in the axial direction of the rotatable setting shaft 8. Hub 29 is provided with an annular groove 48 the region of which can be placed opposite, in a precentered position, two fastening and centering members 49 which are fastened to the bottom 8*c* of a frontal recess 55*a* in the rotatable setting shaft 8.

The fastening and centering members 49 include, as shown particularly in FIGS. 5 and 6, on the one hand, as shown plate 55 provided with a bearing recess 54, the width of bearing recess 55 corresponding essentially to the diameter of the hub 29 of the print wheel 2 and, furthermore, of two latching hooks 57 pivotally mounted via two bearing bolts or pins 56 in the receiving bearing plate 55. The latching hooks 57 are always under the influence of biasing forces produced by common latching spring 58 in such a manner that a cam region 59 of each hook is urged into the annular groove 48 of the hub 29 of the print wheel 2. Each latching hook 57 is provided with an adjustment tongue 60 which protrudes radially through recess 8*d* in the collar 8*a* of the rotatable setting shaft 8 and extends into the adjustment range of a respective control latch 61. The latching hooks 57 are pivotal in such a way that their cam regions 59 can be pivoted out of the annular groove 48 of the print carrier 2, as shown in FIG. 6.

The control latches 61 are formed of two-armed levers which are always under the influence of reset springs 62 and are pivotally mounted at tongues 63 on the lateral walls 18 of the insertion shaft 17. As further shown in FIG. 5*a* a transmission lever 64 is pivotally mounted on each of the lateral walls 18 to form-lockingly engage, via a first arm 64*a*, in a long hole 61*a* of the associated latching hook 61. The second arm 64*b* of each lever 64 is disposed in front of an adjustment tongue 19*a* of pressure plate 19 so that, upon a clockwise pivoting movement of pressure plate 19, with respect to the plane of FIG. 5*a*, levers 64 are adjusted counterclockwise and the associated latching hooks 61 are adjusted, against the influence of their resetting springs 62, so that they take on the positions shown in FIG. 6 in which the hub 29 of print wheel 2 has been released from the latching hooks 57.

The collar 8*a* of the rotatable setting shaft 8 which, as shown in FIG. 2, is also provided with a ring 65 of teeth for engagement with a gear belt 67, is provided with a substantially wedge-shaped detent recess 47 which serves to receive a carrier hook 46 provided on the print wheel 2 and designed accordingly.

As shown in FIG. 2, collar 8*a* is designed pot like and bearing plate 55 and the two latching hooks 57 are arranged inwardly of frontal ring 8*b* and fastened by the bottom 8*c*. In FIG. 2, the collar 8*a* is shown with a broken portion whereby the cross-sectional plane passes a line II—II seen in FIG. 6.

During the insertion movement of the casssette 1 from the top into the insertion shaft 17 (see FIGS. 3 and 4), the curved region 23 of guide grooves 22 effects that the cassette 1 leads out a movement which is directed at first to the left hand and then in opposite direction so that hub 29 (FIG. 2) is moving over the frontal ring 8*b* of collar 8*a* before the same enters into the frontal recess 55*a* of the collar 8*a*.

Reverting to FIGS. 7 and 8, a one-armed lever 40 which serves as a handle is pivotally mounted on the machine part 9 by means of a pivot bearing 68, the lever being articulated via a coupling 69 with the pressure plate 19 and being manually movable from the position shown in FIG. 7 to the position shown in FIG. 8, the latter position resulting in release of the cassette.

The cassette 1, which in the unmounted state keeps the print wheel in a position secure against rotation by means of its arresting means 24 in that the leaf springs 30 forming the arresting means protrude into the interior of the cassette, is inserted into the insertion shaft 17, for the purpose of mounting it on the rotatable setting shaft 8, between the lateral walls with guide members 21 until its lower edge 36, which acts as control means, comes to abut on the abutment tongue 51 of control lever 38.

As shown in FIG. 8, lever 38 takes on a clockwise pivoted position when in the unmounted state, i.e. when no cassette is present, and consequently the blocking lever 43 is forced by the ejection spring means 37 to take on a counterclockwise pivoted position in which the supporting tongue 43*c* of the blocking lever 43 contacts the supporting tongue 42*a* of the pressure plate 19. In this rest position, the pressure plate 19 is likewise in a position pivoted counterclockwise against the influence of the tension spring 41, where it is held by contact with a contact wedge 70 of the blocking lever 43. If now a cassette is inserted and manually pushed downwardly, the control lever 38 pivots counterclockwise, thus causing engagement of the detent tongue 35 in the recesses 15 in the cassette 1. At the same time the counterclockwise pivoting movement of control arm 38 causes control lever 43 to be pivoted clockwise in such a way that the supporting tongue 42*a* of pressure plate 19 is released from the abutment edge 70 so that plate 19 can pivot clockwise, under the action of tension spring 41, until arm 42 comes against abutment 52. This prevents the blocking lever 43 and thus also the control lever 38 from performing a return movement since the supporting tongue 42*a* of the pressure plate 19 prevents this and thus finally causes the cassette to be finally arrested in the inserted position.

Figure 6A:
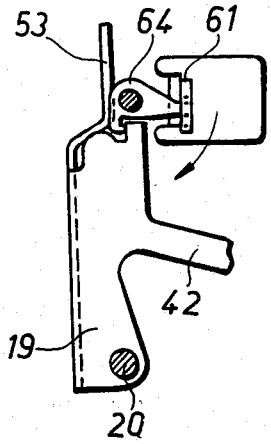
FIG. 6*a* is a view similar to that of FIG. 5*a*, but looking from the opposite side, a portion of the mechanism in its wheel releasing position.

The clockwise pivoting movement of pressure plate 19 presses its protrusion 53 against the frontal face 45 of hub 29 of the print wheel 2 and thus displaces it slightly in the axial direction until annular groove 48 has safely reached the immediate effective range of the fastening and centering members 49. Since the annular groove 48 has a conical shape, i.e. is delimited by outwardly diverging side walls, the hub 29 will be urged in the axial direction by the cam regions 59 of the latching hooks 57 forming the centering members until the print wheel has taken up its final installed position where its contact edge contacts the frontal ring 8*b* of the rotatable setting shaft 8. The latching hooks 57 are thus pivoted by their associated latching spring 58 into their effective position once the latching levers 61 have been pivoted by their resetting spring 62 from the position shown in FIGS. 6 and 6*a* to the position shown in FIGS. 5 and 5*a*. This pivotal movement, which releases the latching hooks 57, is made possible because the transmission levers 64 are being released for corresponding pivoting movement by the pressure plate 19, 19*a* when it pivots into its effective position for bringing wheel 2 into engagement with shaft 8.

Since the pressure plate cooperates with a fixed abutment on the machine, constituted by abutment 52, the protrusion 53 can be adjusted in such a mannner that in the final mounted position of the print wheel 2 it will no longer have any friction contact with protrusion 53. The print wheel 2 is secured against rotation relative to the rotatable setting shaft 8 by means of the wedge-shaped follower tongue 46 which, when the cassette 1 is inserted into the insertion shaft 17, is initially relatively loosely seated in the associated detent groove 47 of the rotatable setting shaft 8 and is then firmly pushed into the detent groove 47 by the axial movement of the print wheel 2 with respect to the rotatable setting shaft 8.

During this final seating movement of the print wheel, the latter is able to move freely within the cassette 1, since sufficient play is provided in the cassette and also between the holding means 7 in the form of a protrusion on the print wheel and a bearing opening 6 in the cassette 1.

If the cassette 1 is to be exchanged for another cassette, for example to change the type of script, it must of course first be removed from the mounted position. This is effected by manually pivoting the handle 40 counterclockwise, with respect to the plane of FIGS. 7 and 8, which pivots the pressure plate 19, via the coupling 69 and against the effect of tension spring 41, in a counterclockwise direction about pivot 20 so that the latching levers 61 are pivoted, via the transmission levers 64, against the effect of the resetting springs 62 and the latching hooks 57 are thus returned to their inoperative position, as shown in FIG. 6. At the same time, referring to FIG. 8, the blocking lever 43 is released by supporting tongue 42*a* on arm 42 of pressure plate 19 so that the bias applied by ejection spring means 37 suddenly pivots the lever 43 in a counterclockwise direction. This causes the control lever 38 to also suddenly pivot clockwise, thus releasing the detent hooks 35 from their blocking position and the contact tongue 51 suddenly pushes the cassette 1 upwardly. Since the pivotal movement of the pressure plate 19 also returns its protrusion 53 into the starting position, which is to the left, the cassette 1 can now be removed from the insertion shaft 17, for example after closing the cassette by means of cover 3.

The arresting means of the cassette 1 and the supporting means 25 for the print wheel 2 are necessary, in particular, for those office machines in which the rotatable setting shaft is set by means of a drive device which is able to provide only a very defined setting position, i.e. this drive device can impart the various desired angles of rotation to the print wheel only from a precisely determined zero position which of course requires a precisely defined position for the print wheel with respect to the zero position of the rotatable setting shaft when the print wheel is to be exchanged. A prerequisite for this is that the rotatable setting shaft 8 be turned into a so-called zero position before the type carriers are exchanged, which may be done according to an automatic process control by means which are not shown here.

It is also possible, however, to design printers so that they automatically perform a rotary movement after each exchange of type carriers, or print wheels, e.g. upon actuation of the mains switch until a zero position has been determined at the print wheel itself or at a counting disc which is used from that moment on by the processor of the printer as the starting base for the rotary setting movements. With such printers, the rotary arrest of the print wheel within the cassette, when in the unmounted state, is of course not necessary so that the parts provided for that purpose in a type carrier receiving arrangement according to the present invention can be eliminated.

Figure 9:
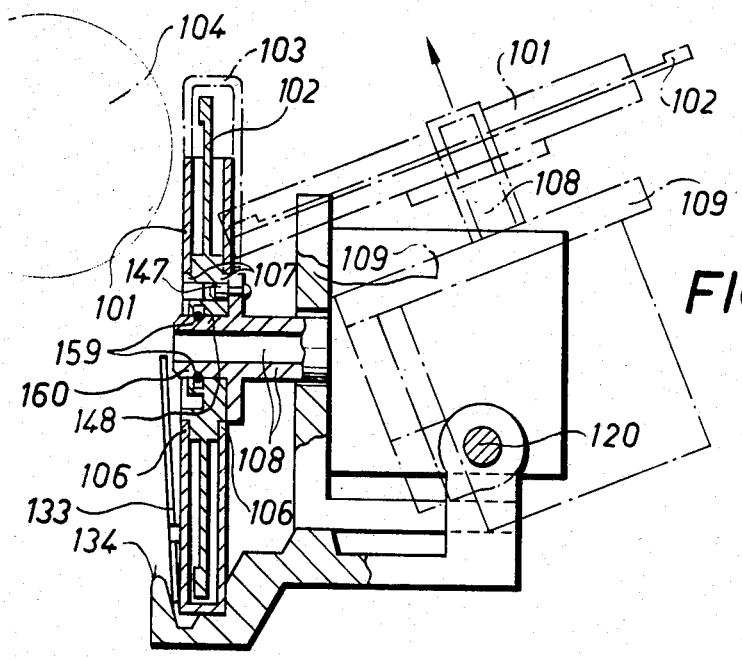
FIGS. 9 and 10 are a side elevational cross-sectional view and a front elevational view, respectively, of a further embodiment of a type carrier cassette according to the invention for a printer having a rotatable setting shaft which is pivotally mounted for exchanging the type carrier.
Figure 10:
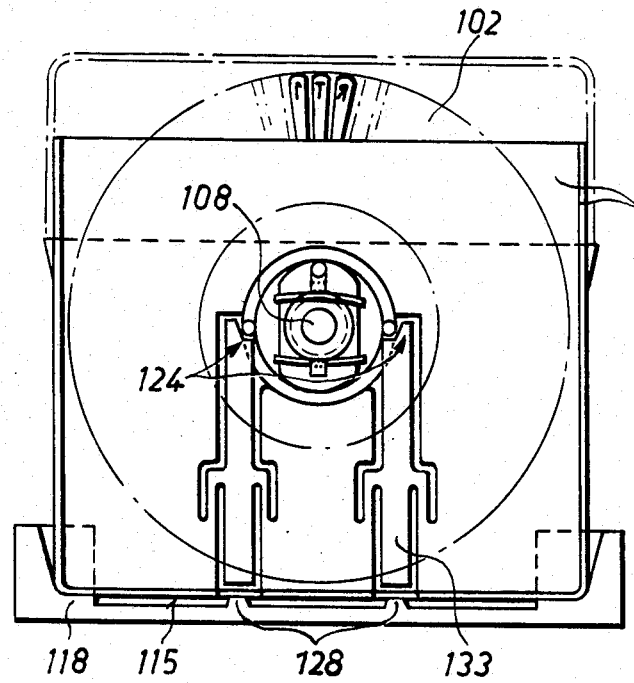

The above is a description of a receiving arrangement for a print wheel for typewriters or similar office machines in which the rotatable setting shaft is fixedly mounted in a part of the carriage frame. It is, however, just as possible to provide a print wheel receiving arrangement according to the invention in which, as shown in FIGS. 9 and 10, the rotatable setting shaft 108 is mouted on a carrier 109 pivotal about a shaft 120 fixed to the machine to enable carrier 109 to be pivoted into a position remote from platen 104 so that the cassette 101 which can be closed by means of a cover 103, can be removed axially essentially in an upward direction and inserted in a downward direction without being impeded by the platen 104. The coupling of the print wheel 102 with the rotatable setting shaft 108 is effected via a pin 147 carried by the shaft and a bore in the hub, or bearing protrusion, 107 of the print wheel 102.

In a most simple manner, care need only be taken that the print wheel 102 is rotatably mounted directly in the bearing recess 106 of the cassette 101 via bearing protrusion 107 on either side, which acts as holding means, that there is only bearing play, and that the print wheel itself is provided with simple plug-in connecting means for connection with the rotatable setting shaft 108.

The plug-in connecting means may include two rod-shaped detent springs 159 provided in the bearing bore 148 in the hub 147 of the print wheel 102, which, when the print wheel is pushed onto the rotatable setting shaft 108, engage in an annular groove 160 provided therein. This would then make it possible to push the print wheel 102 onto the rotatable setting shaft 108, or to remove it therefrom, by means of the cassette 101 whereby the cassette, after the print wheel has been pivoted into the printing position, would need to be blocked in its bottom, or bearing, region 115 only against rotation with the rotatable setting shaft 108. Such blocking is achieved by rotation securing means 118 in the machine which act as holding members. These rotation securing means 118 which may have a cup-like design, may be provided with control members 128 which are designed in the form of protrusions having oblique faces 134 and cooperate with control lever arms 133 of arresting means 124 similar to means 24, if such arresting means are required for the printing device in question.

Figure 11:
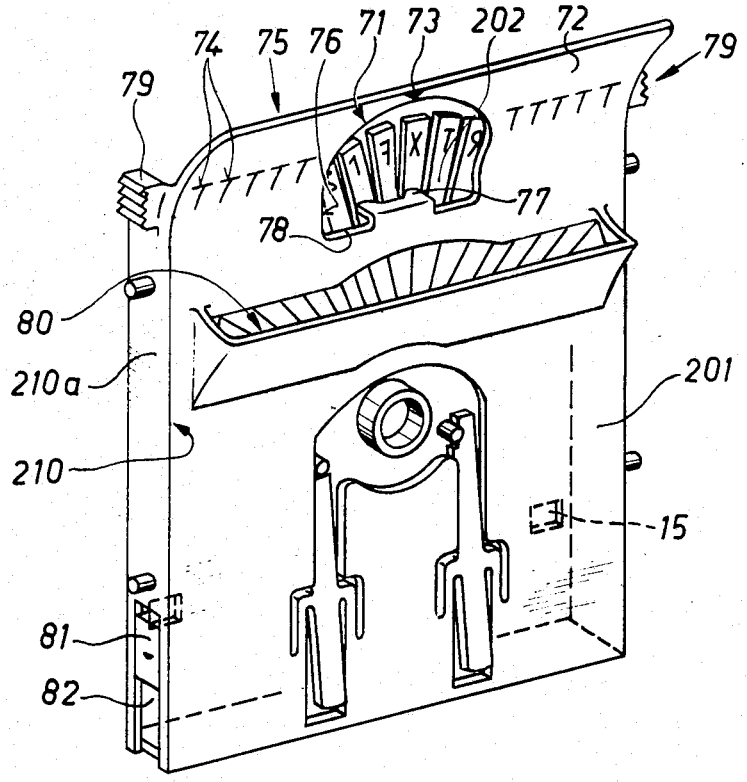
FIG. 11 is a perspective view illustrating specific details of a type carrier cassette according to the invention.

Turning now to FIG. 11, a cassette 201 for a print wheel 202 which is provided with resilient type spokes may have an upper region, which will be placed directly opposite the platen, in the form of a card holder 71 and/or a line adjuster 72. For this purpose the cassette 201 is provided with a recess 76 in its region 75 which directly faces the platen and is adapted in its shape to this platen. This recess 76 simultaneously serves as a passage opening for the character types. A center marker 73 and line alignment markers 74 are provided in this upper region 75. In this case, at least the upper region of cassette 201 will be made of a transparent material.

Furthermore, the cassette 201 may be provided in the printing region with a guide member 77 presenting a wedge-shaped recess which serves to laterally center the spring spoke carrying the selected character type during a striking movement and which is formed at the lower edge 78 of the recess 76.

Additionally, the card holder 71 or the line adjuster 72 of the cassette may be formed into a handle portion 79 which serves to permit manual handling of the cassette.

The cassette 201 may additionally be provided, at its frontal face 210 facing the platen, with an outwardly curved collecting funnel 80 which then serves to collect dirt particles which may drop from the print transfer material during printing, for example form a correctable carbon ribbon. These dirt particles then drop down inside the cassette 201 and are collected at its bottom. In order to be able to easily remove these dirt particles from the cassette, a closable discharge opening 82 may be provided at one side face 210*a* thereof, which opening can be closed by a covering slide 81.

The accessory devices for the cassette 201 described with reference to FIG. 11 may also be provided individually on a cassette if the other devices are already provided in the office machine, for example in the form of means which are part of the machine.

It will be understood that the above description of the present invention is susceptible to various modifications, changes and adaptations, and the same are intended to be comprehended within the meaning and range of equivalents of the appended claims.

What is claimed is:

1. In a combination including a print wheel provided with a plurality of elastic spokes carrying print type faces and a cassette carrying the print wheel for removably mounting the print wheel in an impact printer having a printing hammer mechanism arranged to act on the type faces, a rotatable setting shaft, connecting means for releasably fastening the print wheel to the setting shaft and holding members for holding the cassette in a mounted position in the printer, the improvement wherein: said print wheel comprises positioning means; said cassette comprises arresting means for normally engaging said positioning means in order to hold said print wheel in a predetermined angular position relative to said cassette when said cassette and print wheel are removed from the printer, said arresting means being disengageable from said positioning means when said cassette is in the mounted position in the printer and said printer wheel is fastened to the setting shaft; said positioning means comprise pin elements protruding axially from said print wheel; and said arresting means comprise two supporting tongues and support means supporting said tongues on said cassette for movement in the direction of the axis of said print wheel into a position where said tongues engage said pin elements, and further comprising control means mounted on the printer to act on said support means to disengage said tongues from said pin elements when said cassette is in said mounted position.

2. An arrangement as defined in claim 1 wherein said control means comprise at least one projecting element presenting a sloped camming surface disposed to cooperate with said support means.

3. An arrangement as defined in claim 1 wherein said support means comprise two leaf springs each pivotally mounted to said cassette, each said spring carrying a respective tongue at a free end thereof and presenting a control arm arranged to cooperate with said control means.

4. An arrangement as defined in claim 3 wherein said control arms constitute portions of one face of said cassette and are delimited by cutouts formed in that face, and said leaf springs further comprise elastic pivot bearing means in the form of bars integral with that cassette face, delimited by such cutouts, and supporting said spring from the portions of that cassette face adjacent said springs.

5. An arrangement as defined in claim 4 wherein said pin elements are integral with said print wheel.

6. In apparatus for releasably holding a print wheel provided with a plurality of elastic spokes carrying print type faces in an impact printer having a printing hammer mechanism arranged to act on the type faces and a rotatable setting shaft to which the print wheel can be releasably fastened, which apparatus includes a cassette carrying the print wheel, the cassette being insertable into, and removable from, the printer together with the print wheel, the cassette being provided with guide members, and cassette holding means carried by the printer and defining an insertion shaft extending substantially transversely to the axis of the setting shaft and arranged to cooperate with the guide members to guide the cassette during insertion into the printer, the improvement wherein: said cassette holding means comprise detent means; said cassette is provided with counterdetent means positioned to engage said detent means to hold said cassette in a fully inserted position in which the print wheel is fastened to the setting shaft; said cassette holding means further comprise ejection spring means arranged to move said cassette away from said fully inserted position upon disengagement of said detent means from said counter detent means; said detent means comprise at least one pivotal control level carrying a detent tongue engageable with said counterdetent means; said cassette presents control means located to act on said level to pivot it into a position for causing said tongue to engage said counterdetent means when said cassette moves into its fully inserted position; said ejection spring means produces a force opposing movement of said cassette into its fully inserted position; and said cassette holding means further comprise a blocking device disposed for blocking said lever in said position in which said tongue engages said counterdetent means, and a release member in the form of a handle connected to act on said blocking device and manually movable in a direction for moving said blocking device into a position in which said tongue disengages from said counterdetent means.

7. An arrangement as defined in claim 5 wherein: said blocking device comprises a guide member pivotally mounted in the printer and having a protruding portion defining a pressure plate for pressing said print wheel into engagement with the coupling means; a biassing spring connected to said blocking device to urge said plate toward said print wheel, an arm carried by said guide member, and a blocking lever operatively connected between said control lever and said arm for limiting the travel of said pressure plate toward said print wheel under the influence of said biassing spring; said print wheel is provided with a central, axially extending hub having an annular groove in its outer surface and with a projection offset from, and extending parallel to, said hub and having a wedge-shaped cross section; and said apparatus further comprises connecting means associated with the setting shaft and provided with a detent recess positioned and shaped to mate with said projection when said print wheel is fastened to said setting shaft for causing said print wheel to rotate in unison with said setting shaft, said connecting means comprising fastening and centering members movable into a position for engaging said annular groove of said hub in a manner to center said print wheel radially and position said print wheel axially relative to the setting shaft, said fastening and centering means being connected to have their movement controlled indirectly by movement of said release member.

8. A receiving arrangement for holding a print wheel provided with a plurality of elastic spokes carrying print type faces in an impact printer having a rotatable setting shaft to which the print wheel can be releasably fastened for rotation with the shaft, said receiving arrangement comprising: a cassette formed to enclose the print wheel while leaving exposed the immediate region of the type face with which a printing operation is to be performed; arresting means supported by, and movable relative to, said cassette, between a normal position in which said arresting means engage the print wheel to cause the print wheel to be held in a predetermined angular position relative to said cassette, and a release position in which rotation of the print wheel by the shaft is permitted, said arresting means including at least one supporting element formed to cooperate with the print wheel, when said arresting means are in their normal position, in such a manner as to apply to the print wheel a positive arresting force which holds the print wheel in its predetermined angular position and which responds to any tendency of the print wheel to rotate out of the predetermined angular position in a manner to return the print wheel to that angular position, said arresting means being maintained in their normal position when the print wheel is disconnected from the rotatable shaft; and guide means carried by said cassette for holding said cassette in position in the printer when the print wheel is fastened to the setting shaft.

9. An arrangement as defined in claim 8 wherein said guide means comprise guide pins protruding laterally from said cassette, and said insertion shaft is defined by laterally spaced guide grooves for receiving said guide pins, said grooves having a curved region for imparting to said cassette, during insertion into the printer, a movement having a component directed along the axis, and toward, the setting shaft for effecting provisional coupling between the print wheel and the setting shaft.

10. In combination including a print wheel provided with a plurality of elastic spokes carrying print type faces and a cassette carrying the print wheel for removably mounting the print wheel in an impact printer having a rotatable setting shaft to which the print wheel can be releasably fastened for rotation with the shaft, the improvement wherein: said cassette and said print wheel are provided with cooperating means for positively holding said print wheel in said cassette when said wheel is disconnected from the shaft; said cassette comprises means for holding said cassette in position in the printer when the print wheel is fastened to the setting shaft; said means for holding comprise a protrusion formed integrally with said print wheel and an opening formed in said cassette to receive said protrusion while permitting said print wheel to have bearing play relative to said cassette for enabling said cassette to be held in position in the printer independently of the position of said print wheel when fastened to the setting shaft; and said print wheel comprises positioning means, and further comprising arresting means supported by, and movable relative to, said cassette, between a normal position in which said arresting means engage said print wheel positioning means to hold said print wheel in a predetermined angular position relative to said cassette, and a release position in which rotation of said print wheel by the shaft is permitted, said arresting means including at least one supporting element formed to cooperate with said print wheel positioning means, when said arresting means are in their normal position, in such a manner as to apply to said print wheel a positive arresting force which holds said print wheel in its predetermined angular position and which responds to any tendency of said print wheel to rotate out of the predetermined angular position in a manner to return said print wheel to that angular position, said arresting means being maintained in their noraml position when said print wheel is disconnected from the rotatable shaft.

11. The combination defined in claim 10 wherein said positioning means comprise pin elements protruding axially from said print wheel, and said arresting means comprise two supporting tongues and support means supporting said tongues on said cassette for movement in the direction of the axis of said print wheel between said normal and release positions, said tongues engaging said pin elements when said arresting means are in their normal position.

12. The combination defined in claim 11 further comprising control means mounted on the printer for moving said arresting means into their release portion, in which said tongues disengage from said pin elements when said cassette is held in position in the printer.

13. The combination defined in claim 12 wherein said support means comprise two leaf springs each pivotally mounted to said cassette, each said spring carrying a respective tongue at a free end thereof and presenting a control arm arranged to cooperate with said control means.

14. The combination defined in claim 13 wherein said control arm constitute portions of one face of said cassette and are delimited by cutouts formed in that face, and said leaf springs further comprise elastic pivot bearing means in the form of bars integral with that cassette face, delimited by such cutouts, and supporting said spring from the portions of that cassette face adjacent said springs.

15. The combination defined in claim 11, 12, 13, or 14 wherein said pin elements are integral with said print wheel.

16. The combination defined in claim 29, 30 or 31 wherein said control means comprise at least one projecting element presenting a sloped camming surface disposed to cooperate with said support means.

* * * * *